US008628900B2

(12) United States Patent
Kadokura et al.

(10) Patent No.: US 8,628,900 B2
(45) Date of Patent: Jan. 14, 2014

(54) ELECTROSTATIC CHARGE IMAGE DEVELOPING TONER, ELECTROSTATIC CHARGE IMAGE DEVELOPER, TONER CARTRIDGE, PROCESS CARTRIDGE, IMAGE FORMING APPARATUS, AND IMAGE FORMING METHOD

(75) Inventors: Yasuo Kadokura, Kanagawa (JP); Shunsuke Nozaki, Kanagawa (JP); Hideaki Yoshikawa, Kanagawa (JP); Shinichiro Kawashima, Kanagawa (JP); Sakae Takeuchi, Kanagawa (JP); Yuka Zenitani, Kanagawa (JP); Sakon Takahashi, Kanagawa (JP); Hiroyoshi Okuno, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 11 days.

(21) Appl. No.: 13/352,821

(22) Filed: Jan. 18, 2012

(65) Prior Publication Data

US 2013/0065170 A1 Mar. 14, 2013

(30) Foreign Application Priority Data

Sep. 13, 2011 (JP) ..... 2011-199904

(51) Int. Cl.
*G03G 9/00* (2006.01)

(52) U.S. Cl.
USPC ..... 430/108.6; 430/105; 430/108.7

(58) Field of Classification Search
USPC ..... 430/108.1–108.9
See application file for complete search history.

(56) References Cited

U.S. PATENT DOCUMENTS

| | | | | |
|---|---|---|---|---|
| 5,725,987 | A * | 3/1998 | Combes et al. | 430/137.11 |
| 6,514,654 | B1 * | 2/2003 | Kanbayashi et al. | 430/122.2 |
| 2003/0148203 | A1 * | 8/2003 | Suzuki et al. | 430/110.3 |
| 2008/0233505 | A1 | 9/2008 | Nagatomo et al. | |
| 2009/0111042 | A1 * | 4/2009 | Kiyono et al. | 430/108.6 |

FOREIGN PATENT DOCUMENTS

| | | |
|---|---|---|
| JP | A-11-327194 | 11/1999 |
| JP | A-11-327195 | 11/1999 |
| JP | A-2008-262171 | 10/2008 |
| JP | A-2009-237090 | 10/2009 |

OTHER PUBLICATIONS http://www.sensorsone.com/change-bar-into-megapascal-mpa-pressure/, SensorsONE Ltd, PO Box 8286, Oakham, Rutland, LE15 0AW, United Kingdom, 2013.*

* cited by examiner

*Primary Examiner* — Mark F Huff
*Assistant Examiner* — Rashid Alam
(74) *Attorney, Agent, or Firm* — Oliff & Berridge, PLC

(57) ABSTRACT

An electrostatic charge image developing toner includes: toner particles; and an external additive. The external additive contains sol-gel silica having a volume average particle diameter of from about 70 nm to about 400 nm and an average circularity of from about 0.5 to about 0.9, and a dielectric loss factor of the toner is from about $5\times10^{-3}$ to about $30\times10^{-3}$ when the toner is kept for 24 hours under the environment of a temperature of 28° C. and a humidity of 85%.

12 Claims, 2 Drawing Sheets

ELECTROSTATIC CHARGE IMAGE DEVELOPING TONER, ELECTROSTATIC CHARGE IMAGE DEVELOPER, TONER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2011-199904 filed Sep. 13, 2011.

BACKGROUND

1. Technical Field

The present invention relates to an electrostatic charge image developing toner, an electrostatic charge image developer, a toner cartridge, a process cartridge, an image forming apparatus, and an image forming method.

2. Related Art

Visualizing image information via an electrostatic latent image, such as an electrophotographic method, is used in various fields. In the electrophotographic method, an electrostatic latent image formed on a photoreceptor is developed by a developer containing a toner through a charging process and an exposure process, and visualized through a transfer process and a fixing process.

As the above-described toner, a toner containing silica particles as an external additive is known, and for example, toners are proposed.

SUMMARY

According to an aspect of the invention, there is provided an electrostatic charge image developing toner including: toner particles; and an external additive, in which the external additive contains sol-gel silica having a volume average particle diameter of from about 70 nm to about 400 nm and an average circularity of from about 0.5 to about 0.9, and a dielectric loss factor of the toner is from about $5\times10^{-3}$ to about $30\times10^{-3}$ when the toner is kept for 24 hours under the environment of a temperature of 28° C. and a humidity of 85%.

BRIEF DESCRIPTION OF THE DRAWINGS

Exemplary embodiments of the present invention will be described in detail based on the following figures, wherein.

DETAILED DESCRIPTION

Figure 1:
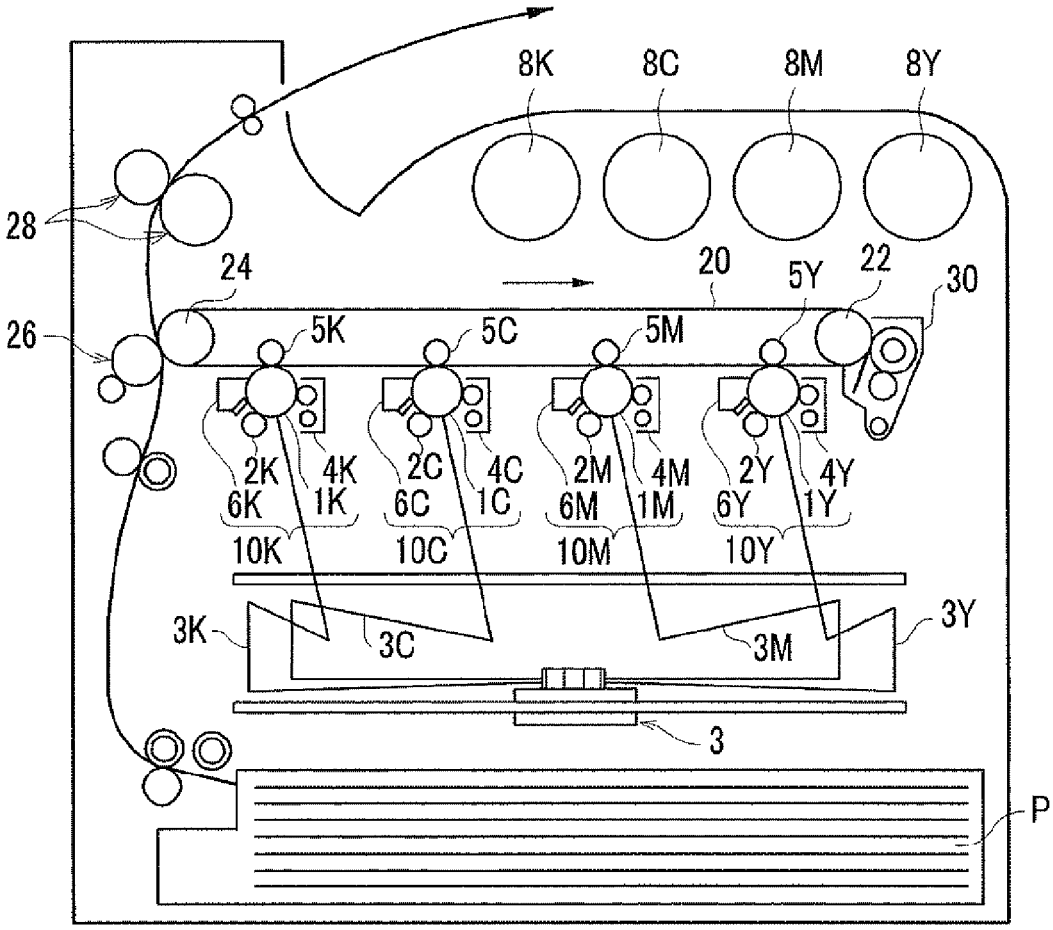
FIG. 1 is a diagram schematically showing the configuration of an example of an image forming apparatus according to an exemplary embodiment.

Hereinafter, exemplary embodiments of the invention will be described in detail.

<Electrostatic Charge Image Developing Toner>

An electrostatic charge image developing toner according to this exemplary embodiment (hereinafter, simply referred to as "toner" in some cases) is an electrostatic charge image developing toner that includes toner particles and sol-gel silica adhering to surfaces of the toner particles and having a volume average particle diameter of from 70 nm to 400 nm (or from about 70 nm to about 400 nm) and an average circularity of from 0.5 to 0.9 (or from about 0.5 to about 0.9), and that has a dielectric loss factor of from $5\times10^{-3}$ to $30\times10^{-3}$ (or from about $5\times10^{-3}$ to about $30\times10^{-3}$) when being kept for 24 hours under the environment of a temperature of 28° C. and a humidity of 85% or about 85%.

The toner having such a configuration can suppress a fluctuation in the electrostatic property due to environmental changes over a long period of time. The reason for this is not clear, but may be as follows.

It is known that in the toner that contains toner particles obtained by a wet preparation method with a higher dielectric loss factor than conventional preparation methods, the electrification rise with the passage of time under the low humidity environment tends to be prevented.

However, in such a toner, when silica having a spherical shape and a large diameter is used as an external additive as in the related art, there is a problem in that the electrostatic property is reduced under the high humidity environment. It is thought that the reason for this is that silica having a spherical shape and a large diameter for obtaining a spacer effect moves to concave portions of the surfaces of the toner particles and the caught silica is further embedded in the toner particles due to the continuous mechanical stress applied to the toner, whereby the coverage by the silica on convex portions of the surfaces of the toner particles is reduced, and moreover, particularly, at a high humidity, the moisture adheres to the toner surface on which the coverage is reduced.

Here, the large diameter is a volume average particle diameter that is 70 nm or greater.

The toner according to this exemplary embodiment uses sol-gel silica having a relatively large diameter and a non-spherical shape as an external additive. Since the sol-gel silica has an irregular shape, and has a shape with no edge on the surface, resulting from the producing method thereof (sol-gel method), particle destruction and the embedding in the toner due to external stress are suppressed, and the movement of the sol-gel silica to the concave portions of the surfaces of the toner particles is also suppressed (that is, the sol-gel silica according to this exemplary embodiment has a shape which does not easily move on the surfaces of the toner particles).

Therefore, even at the high humidity, the coverage by the silica on the convex portions of the surfaces of the toner particles is maintained.

In addition, the toner according to this exemplary embodiment has a high dielectric loss factor even under the high humidity environment, and as described above, under the low humidity environment, the electrification rise with the passage of time is prevented.

As a result, it is thought that the toner according to this exemplary embodiment can suppress a fluctuation in the electrostatic property over a long period of time even when the humidity environment changes.

First, the dielectric loss factor of the toner according to this exemplary embodiment will be described.

The dielectric loss factor of the toner according to this exemplary embodiment is from $5\times10^{-3}$ to $30\times10^{-3}$ (or from about $5\times10^{-3}$ to about $30\times10^{-3}$), and preferably from $10\times10^{-3}$ to $20\times10^{-3}$ (or from about $10\times10^{-3}$ to about $20\times10^{-3}$) when the toner is kept for 24 hours under the environment of a temperature of 28° C. and a humidity of 15%.

When the dielectric loss factor is less than $5\times10^{-3}$, the charging at a low humidity (under the environment of a temperature of 28° C. and a humidity of 15%) is difficult to maintain. In addition, when the dielectric loss factor is greater than $30\times10^{-3}$, the above-described charging at a high humidity is difficult to maintain.

The dielectric loss factor of the toner is measured as follows.

First, 5 g of a toner is molded into pellets and kept for about 24 hours under the environment of a temperature of about 28° C. and a humidity of about 85%. Then, the toner is set between electrodes (electrode for solid SE-71, manufactured by Ando Electric Co., Ltd.) and the measurement is performed by an LCR meter (4274A, manufactured by Yokogawa Hewlett-Packard Development Company, L. P.) at 5 V and at a frequency of 100 kHz.

The dielectric loss factor is obtained by the following Expression (1).

$$(14.39/(W\times D^2))\times Gx\times Tx\times10^{12} \quad \text{Expression (1)}$$

Here, W is equal to 2πf (f: measurement frequency 100 kHz), D represents an electrode diameter (cm), Gx represents a conductivity (S), and Tx represents a sample thickness (cm).

The above-described dielectric loss factor of the toner can be controlled by, for example, a toner particle producing method (whether or not the toner particles are produced by a wet method), a hydrophobization degree of the surface of sol-gel silica, hydrophobization treatment conditions for sol-gel silica and the like.

In this exemplary embodiment, the dielectric loss factor is preferably controlled by hydrophobization treatment conditions for sol-gel silica.

Next, the toner particles, sol-gel silica, and other components of the toner according to this exemplary embodiment will be described in detail.

First, the toner particles will be described.

(Toner Particles)

Toner particles contain, for example, a binder resin, and if necessary, other additives such as a colorant and a release agent.

The binder resin is not particularly limited, but examples thereof include homopolymers and copolymers of styrenes (such as styrene and chlorostyrene), monoolefins (such as ethylene, propylene, butylene and isoprene), vinylesters (such as vinyl acetate, vinyl propionate, vinyl benzoate and vinyl butyrate), α-methylene aliphatic mono-carboxylic acid esters (such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate), vinyl ethers (such as vinyl methyl ether, vinyl ethyl ether and vinyl butyl ether), vinyl ketones (such as vinyl methyl ketone, vinyl hexyl ketone and vinyl isopropenyl ketone), polyester resins by copolymers of dicarboxylic acids and diols, and the like.

Particularly representative examples of the binder resin include polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, a polyethylene resin, a polypropylene resin, a polyester resin, and the like.

Particularly, in the case of a polyester resin, since an ester group is present on the toner surface, it is easily influenced by the moisture adhering after the external additive moves as described above. Accordingly, when toner particles containing a polyester resin are employed, the influence of suppressing a fluctuation in the electrostatic property due to environmental changes over a long period of time is remarkable.

The colorant is not particularly limited if it is a known colorant. Examples thereof include carbon black such as farness black, channel black, acetylene black and thermal black, inorganic pigments such as colcothar, Prussian blue and titanium oxide, azo pigments such as Fast yellow, disazo yellow, pyrazolone red, chelate red, brilliant carmine and para Brown, phthalocyanine pigments such as copper phthalocyanine and metal-free phthalocyanine, and condensed polycyclic dyes such as flavanthrone yellow, dibromoanthrone orange, perylene red, quinacridone red and dioxazine violet.

Regarding the colorant, if necessary, a surface-treated colorant may be used and a dispersant may be used in combination. In addition, various kinds of colorants may be used in combination.

The content of the colorant is preferably in the range of from 1 part by mass to 30 parts by mass with respect to 100 parts by mass of the binder resin.

Examples of the release agent include hydrocarbon-based wax; natural wax such as carnauba wax, rice wax and candelilla wax; synthetic or mineral and petroleum-based wax such as montan wax; ester-based wax such as fatty acid ester and montanic acid ester; and the like. However, the release agent is not limited thereto.

From the point of view of preservability, the melting point of the release agent is preferably 50° C. or higher, and more preferably 60° C. or higher. In addition, from the point of offset resistance, the melting point is preferably 110° C. or lower, and more preferably 100° C. or lower.

The content of the release agent is preferably, for example, in the range of from 2 parts by mass to 30 parts by mass with respect to 100 parts by mass of the binder resin.

Examples of other additives include a magnetic material, a charge-controlling agent, an inorganic powder and the like. The toner particles contain these additives as an internal additive.

The toner particles may have a single layer structure, or a so-called core-shell structure constituted of a core portion (core particles) and a cover layer (shell layer) covering the core portion.

Here, toner particles having a core-shell structure may be constituted of, for example, a core portion containing a binder resin, and if necessary, other additives such as a colorant and a release agent, and a cover layer containing a binder resin.

—Volume Average Particle Diameter of Toner Particles—

The volume average particle diameter (D50v) of the toner particles is preferably from 2 μm to 10 μm, and more preferably from 4 μm to 8 μm.

—Particle Size Distribution of Toner Particles—

As the particle size distribution of the toner particles, the volume average particle size distribution index (GSDv) is preferably from 1.13 to 1.25, and more preferably from 1.15 to 1.19.

By adjusting the particle size distribution of the toner particles to the above-described range, a variation in the toner particle surface area is reduced. As a result, a variation in the adhesion state of sol-gel silica can be prevented, and a fluctuation in the charging performance is suppressed.

The volume average particle diameter (D50v) and the value of the volume average particle size distribution index (GSDv) of the toner particles are measured and calculated as follows.

First, a cumulative distribution is drawn from the smallest diameter side for the volume and the number of toner particles in each of particle size ranges (channels) divided on the basis of the particle size distribution of the toner particles that is measured using a measuring device such as a Coulter counter TAII (manufactured by Beckman Coulter, Inc.) or a Multisizer II (manufactured by Beckman Coulter, Inc.). The particle diameter corresponding to 16% in the cumulative distribution is defined as a volume average particle diameter D16v, the particle diameter corresponding to 50% in the cumulative distribution is defined as a volume average particle diameter D50v, and the particle diameter corresponding to 84% in the cumulative distribution is defined as a volume average particle diameter D84v. Using D16v and D84v among them, the volume average particle size distribution index (GSDv) is calculated in accordance with the expression $(D84v/D16v)^{1/2}$.

(Sol-Gel Silica)

Sol-gel silica according to this exemplary embodiment corresponds to silica particles that are obtained by a sol-gel method, and are adhered to the surfaces of the toner particles. Hereinafter, "adhered to the surfaces of the toner particles" may be expressed as "externally added".

—Volume Average Particle Diameter—

The volume average particle diameter of sol-gel silica is from 70 nm to 400 nm (or from about 70 nm to about 400 nm), and preferably from 100 nm to 200 nm (or from about 100 nm to about 200 nm).

Here, when the volume average particle diameter is less than 70 nm, the sol-gel silica is embedded in the toner particles when the sol-gel silica is externally added to the toner particles. In addition, when the volume average particle diameter of the sol-gel silica is greater than 400 nm, the van der Waals' force is reduced, and thus detachment from the toner surface easily occurs and the coverage is not maintained. Accordingly, a fluctuation in the electrostatic property cannot be suppressed. In addition, the sol-gel silica leaks and thus cleanability deteriorates.

The volume average particle diameter of the sol-gel silica corresponds to the 50% diameter (D50v) in the cumulative frequency of the equivalent circle diameter obtained by observing 100 primary particles of the sol-gel silica after external addition of the sol-gel silica to the toner particles by using a scanning electron microscope (SEM) device and analyzing the image of the primary particles, and is measured by this method.

—Average Circularity—

The sol-gel silica according to this exemplary embodiment has an average circularity of from 0.5 to 0.9 (or from about 0.5 to about 0.9), and preferably from 0.7 to 0.8 (or from about 0.7 to about 0.8).

When the circularity of the sol-gel silica is less than 0.5, destruction occurs by external stress in some cases, and when the circularity is greater than 0.9, the sol-gel silica easily rolls on the surfaces of the toner particles when the sol-gel silica is externally added to the toner particles, and thus the sol-gel silica easily moves to the concave portions of the toner particles.

The circularity of the sol-gel silica is obtained as "100/SF2", that is calculated by the following Expression (4), from the analysis of an image of the primary particles obtained by observing the primary particles of the sol-gel silica after external addition of the sol-gel silica to the toner particles by using a SEM device.

$$\text{Circularity Degree}(100/SF2)=4\pi\times(A/I^2) \qquad \text{Expression (4)}$$

(in the expression, I represents a boundary length of the primary particle of the silica particle on the image, and A represents a projection area of the primary particle of the silica particle. SF2 represents a shape factor.)

The average circularity of the sol-gel silica is obtained as a 50% circularity in the cumulative frequency of the equivalent circle diameter of the 100 primary particles obtained by the above-described image analysis.

—Components—

The sol-gel silica according to this exemplary embodiment may be particles having silica, that is, $SiO_2$ as a main component, and may be crystalline or amorphous. In addition, the sol-gel silica may be particles produced using a silicon compound such as glass water or alkoxysilane as a raw material, or particles obtained by pulverizing quartz.

In addition, from the point of view of dispersibility of the sol-gel silica, the surface of the sol-gel silica is preferably treated with a hydrophobizing agent. Examples of the hydrophobization treatment include a method of treating the surface of the sol-gel silica with a hydrophobizing agent under the supercritical carbon dioxide atmosphere, a method of bonding a hydrophobizing agent such as an alkyl group to the surface of the sol-gel silica, and the like. The hydrophobization treatment method will be described later in detail.

The addition amount of the sol-gel silica according to this exemplary embodiment, that is, sol-gel silica having a volume average particle diameter of from 70 nm to 400 nm and an average circularity of from 0.5 to 0.9 is preferably from 0.3 mass % to 15 mass % with respect to the total mass of the toner particles, and more preferably from 0.5 mass % to 10 mass %.

—Producing Method—

The method of producing the above-described sol-gel silica is not particularly limited if it is a method for producing silica particles having a volume average particle diameter of from 70 nm to 400 nm and an average circularity of from 0.5 to 0.9 by applying a sol-gel method. However, the following producing method is preferably applied.

The method of producing the sol-gel silica according to this exemplary embodiment has a process of preparing an alkali catalyst solution that contains an alkali catalyst at a concentration of from 0.6 mol/L to 0.85 mol/L in a solvent containing alcohol (hereinafter, referred to as "alkali catalyst solution preparation process" in some cases) and a process of obtaining silica particles by supplying tetraalkoxysilane in a supply amount of from 0.002 mol/(mol·min) to 0.009 mol/(mol·min) with respect to the alcohol in the alkali catalyst solution and supplying an alkali catalyst in an amount of from 0.1 mol to 0.4 mol per 1 mol of the total supply amount of the tetraalkoxysilane that is supplied per minute (hereinafter, referred to as "silica particle forming process" in some cases).

That is, in the sol-gel silica producing method, in the presence of the alcohol that contains an alkali catalyst at the above-described concentration, tetraalkoxysilane that is a raw material and a separate alkali catalyst that is a catalyst are supplied to form the above-described relationship therebetween, and the tetraalkoxysilane is reacted to form particular silane particles.

In the sol-gel silica producing method, by the above-described method, irregular sol-gel silica having a volume average particle diameter of from 70 nm to 400 nm and an average circularity of from 0.5 to 0.9 is obtained. The reason for this is not clear, but may be as follows.

First, an alkali catalytic solution that contains an alkali catalyst in a solvent containing alcohol is prepared, and when tetraalkoxysilane and an alkali catalyst are supplied to this solution, the tetraalkoxysilane supplied to the alkali catalytic solution is reacted and core particles are formed. At this time, when the concentration of the alkali catalyst in the alkali catalytic solvent is in the above-described range, it is thought that irregular core particles are formed while the formation of coarse aggregates such as secondary aggregates is suppressed. It is thought that the reason for this is that in addition to the catalyst action, the alkali catalyst is coordinated to the surfaces of the formed core particles and contributes to the shape and dispersion stability of the core particles, but when the amount thereof is in the above-described range, the alkali catalyst does not uniformly cover the surfaces of the core particles (that is, the alkali catalyst unevenly adheres to the surfaces of the core particles), and thus the dispersion stability of the core particles is held, but partial deviation occurs in the surface tension and the chemical affinity of the core particles and irregular core particles are formed.

In addition, when the tetraalkoxysilane and the alkali catalyst are continuously supplied, the formed core particles are grown due to the reaction of the tetraalkoxysilane, and silane particles are obtained. Here, it is thought that by supplying the tetraalkoxysilane and the alkali catalyst while maintaining the supply amounts thereof to form the above-described relationship therebetween, the formation of coarse aggregates such as secondary aggregates is suppressed, irregular core particles are grown while the irregular shape thereof is maintained, and as a result, irregular silica particles are formed. It is thought that the reason for this is that by forming the above-described relationship between the supply amounts of the tetraalkoxysilane and the alkali catalyst, the dispersion of the core particles is held and partial deviation in the tension and the chemical affinity of the core particle surfaces is held, whereby the core particles are grown while maintaining the irregular shape.

Here, it is thought that the supply amount of tetraalkoxysilane relates to the particle size distribution and the circularity of silica particles. It is thought that by adjusting the supply amount of tetraalkoxysilane to from 0.002 mol/(mol·min) to 0.009 mol/(mol·min), the probability of contact between the tetraalkoxysilane and the core particles in the particle growth step is raised, and thus before the tetraalkoxysilane is supplied to the core particles without deviation, it is possible to cause the reaction of the tetraalkoxysilane with the core particles. That is, it is thought that there is a deviation in the reaction of the tetraalkoxysilane with the core particles. Therefore, uneven supply of the tetraalkoxysilane to the core particles is facilitated and a variation in the formation of the core particles is caused.

It is thought that the average particle diameter of the silica particles depends on the total supply amount of tetraalkoxysilane.

From the above description, it is thought that in the above-described sol-gel silica producing method, it is possible to obtain irregular sol-gel silica having a volume average particle diameter of from 70 nm to 400 nm and an average circularity of from 0.5 to 0.9 with less generation of coarse aggregates.

In addition, in the alkali catalyst solution preparation process and the silica particle forming process (generally, both processes are also referred to as "sol-gel silica producing process") in the above-described sol-gel silica producing method, since it is thought that irregular core particles are formed and grown while maintaining the irregular shape thereof and silica particles are thus formed, it is thought that it is possible to obtain irregular silica particles having high shape stability with respect to mechanical load.

In addition, in the sol-gel silica producing process, since it is thought that the irregular core particles that are formed are grown while maintaining the irregular shape and silica particles are thus obtained, it is thought that it is possible to obtain silica particles that have strong resistance to a mechanical load and are not easily crushed.

In addition, in the sol-gel silica producing method, particles are formed by supplying tetraalkoxysilane and an alkali catalyst to an alkali catalyst solution and reacting the tetraalkoxysilane, and thus a total used alkali catalyst amount is reduced in comparison to the case of producing irregular silica particles simply by a sol-gel method, and as a result, the omission of the alkali catalyst removing process is also realized. This is particularly favorable when the silica particles are applied to products requiring high purity.

—Alkali Catalyst Solution Preparation Process—

First, the alkali catalyst solution preparation process in the above-described sol-gel silica producing method will be described.

In the alkali catalytic solution preparation process, a solvent containing alcohol is prepared, and an alkali catalyst is added thereto to prepare an alkali catalyst solution.

The solvent containing alcohol may be a single solvent of alcohol, or if necessary, a mixed solvent with other solvents such as water; ketones such as acetone, methyl ethyl ketone and methyl isobutyl ketone; cellosolves such as methyl cellosolve, ethyl cellosolve, butyl cellosolve and cellosolve acetate; and ethers such as dioxane and tetrahydrofuran. In the case of the mixed solvent, the amount of alcohol with respect to other solvents may be 80 mass % or greater (preferably 90 mass % or greater).

Examples of the alcohol include lower alcohols such as methanol and ethanol.

The alkali catalyst is a catalyst for promoting the reaction (hydrolysis reaction, condensation reaction) of tetraalkoxysilane. Examples thereof include basic catalysts such as ammonia, urea, monoamine and quaternary ammonium salt, and particularly, ammonia is preferably used.

The concentration (content) of the alkali catalyst is from 0.6 mol/L to 0.85 mol/L, preferably from 0.63 mol/L to 0.78 mol/L, and more preferably from 0.66 mol/L to 0.75 mol/L.

When the concentration of the alkali catalyst is less than 0.6 mol/L, the dispersibility of core particles in the course of growing the formed core particles may become unstable, and thus coarse aggregates such as secondary aggregates are formed or gelation occurs, whereby the particle size distribution may deteriorate.

On the other hand, when the concentration of the alkali catalyst is greater than 0.85 mol/L, the stability of the formed core particles excessively increases, and thus spherical core particles are formed and irregular core particles having an average circularity of 0.85 or less may not be obtained. As a result, irregular particular silica particles may not be obtained.

The concentration of the alkali catalyst is a concentration with respect to an alcohol catalyst solution (alkali catalyst+catalyst containing alcohol).

—Silica Particle Forming Process—

Next, the silica particle forming process in the above-described sol-gel silica producing method will be described.

The silica particle forming process is a process in which tetraalkoxysilane and an alkali catalyst are supplied to an alkali catalyst solution, and the tetraalkoxysilane is reacted (hydrolysis reaction, condensation reaction) in the alkali catalyst solution to form silica particles.

In this silica particle forming process, at an initial supply period of the tetraalkoxysilane, core particles are formed due to the reaction of the tetraalkoxysilane (core particle forming step), and then silica particles are formed through the growth of the core particles (core particle growing step).

Examples of the tetraalkoxysilane that is supplied to the alkali catalyst solution include tetramethoxysilane, tetraethoxysilane, tetrapropoxysilane, tetrabutoxysilane and the like. However, from the point of view of controllability of the reaction speed, and the shape, particle diameter, particle size distribution and the like of the obtained silica particles, tetramethoxysilane and tetraethoxysilane may be used.

The supply amount of tetraalkoxysilane is from 0.002 mol/(mol·min) to 0.009 mol/(mol·min) with respect to the alcohol in the alkali catalyst solution.

This means that tetraalkoxysilane is supplied in a supply amount of from 0.002 mol to 0.009 mol per minute with respect to 1 mol of the alcohol used in the process of preparing the alkali catalyst solution.

By adjusting the supply amount of tetraalkoxysilane to the above-described range, irregular silica particles having a circularity of from 0.5 to 0.9 are easily formed at a high ratio (for example, 95% by number or greater).

Regarding the particle diameter of the silica particles, depending on the kind of tetraalkoxysilane and the reaction condition, the total supply amount of tetraalkoxysilane that is used in the particle formation reaction is adjusted to 1.08 mol or greater with respect to, for example, 1 L of a silica particle dispersion liquid to obtain primary particles having a particle diameter of 100 nm or greater, and adjusted to 5.49 mol or less with respect to 1 L of a silica particle dispersion liquid to obtain primary particles having a particle diameter of 500 nm or less.

When the supply amount of tetraalkoxysilane is less than 0.002 mol/(mol·min), the probability of contact between the dropped tetraalkoxysilane and the core particles is reduced. However, a long period of time is required until dropping of the total supply amount of tetraalkoxysilane ends, and the production efficiency deteriorates.

When the supply amount of tetraalkoxysilane is greater than 0.009 mol/(mol·min), the supply amount in the reaction of the tetraalkoxysilane in the core particle forming step and the reaction between the tetraalkoxysilane and the core particles in the particle growth becomes excessive. Accordingly, the reaction system is easily gelated, and the formation of the core particles and the growth of the particles are suppressed.

The supply amount of tetraalkoxysilane is preferably from 0.002 mol/(mol·min) to 0.0085 mol/(mol·min), and more preferably from 0.002 mol/(mol·min) to 0.008 mol/(mol·min).

Examples of the alkali catalyst that is supplied to the alkali catalyst solution include the above-described examples. The alkali catalyst to be supplied may be the same kind as or different kind from the alkali catalyst that is contained in advance in the alkali catalyst solution, but the same kind is preferably used.

The supply amount of an alkali catalyst is from 0.1 mol to 0.4 mol per 1 mol of the total supply amount of tetraalkoxysilane that is supplied per minute, preferably from 0.14 mol to 0.35 mol, and more preferably from 0.18 mol to 0.30 mol.

When the supply amount of an alkali catalyst is less than 0.1 mol, the dispersibility of core particles in the course of growing the formed core particles becomes unstable, and thus coarse aggregates such as secondary aggregates are formed or gelation occurs, whereby the particle size distribution may deteriorate.

On the other hand, when the supply amount of an alkali catalyst is greater than 0.4 mol, the stability of the formed core particles excessively increases. Accordingly, even when irregular core particles are formed in the core particle forming step, the core particles are grown into a spherical shape in the core particle growing step, and irregular silica particles are not obtained in some cases.

Here, in the silica particle forming process, tetraalkoxysilane and an alkali catalyst are supplied to an alkali catalyst solution, but this supply method may be a continuous supply method or an intermittent supply method.

In addition, in the silica particle forming process, the temperature (temperature at the time of supply) in an alkali catalyst solution may be, for example, from 5° C. to 50° C., and preferably in the range of from 15° C. to 40° C.

Through the above-described processes, the sol-gel silica according to this exemplary embodiment is obtained. The obtained sol-gel silica corresponds to hydrophilic silica particles.

—Hydrophobization Treatment—

The sol-gel silica obtained as described above corresponds to hydrophilic silica particles, and thus is preferably treated with a hydrophobizing agent.

As an example of the hydrophobization treatment, there is a method of treating the surface of the sol-gel silica with a hydrophobizing agent under the supercritical carbon dioxide atmosphere.

By this method, hydrophobic silica particles in which an environmental fluctuation in the moisture content is suppressed are obtained. The reason for this is not clear, but may be as follows.

In the hydrophobization treatment for surfaces of hydrophilic silica particles by a hydrophobizing agent, when the hydrophobization treatment is performed in the supercritical carbon dioxide, it is thought that the hydrophobizing agent is dissolved in the supercritical carbon dioxide. Since the supercritical carbon dioxide has a characteristic in that the surface tension is excessively low, it is thought that the hydrophobizing agent dissolved in the supercritical carbon dioxide is deeply diffused into the pores of the surfaces of the hydrophilic silica particles with the supercritical carbon dioxide and easily reaches thereto. It is thought that, therefore, not only the surfaces of the hydrophilic silica particles, but also the deepest portions of the pores are made hydrophobic.

Therefore, it is thought that in the hydrophobic silica particles treated with the hydrophobizing agent under the supercritical carbon dioxide atmosphere, an environmental fluctuation in the moisture content is suppressed.

Particularly, in this exemplary embodiment, since the treated hydrophilic silica particles are hydrophilic silica particles (sol-gel silica) that are obtained by a sol-gel method, it is thought that the hydrophilic silica particles obtained by the sol-gel method have more silanol groups present per silica particle surface area than, for example, hydrophilic silica particles obtained by a gas phase method, and thus the hydrophilic silica particles obtained by the sol-gel method have a larger amount of adsorbed water present on the silica particle surfaces. Accordingly, it is thought that the hydrophobization treatment is performed in a state in which the amount of the adsorbed water is large, and thus it is possible to obtain hydrophobic silica particles in which an environmental fluctuation in the moisture content is suppressed in a state in which the moisture content is high.

In addition, when the hydrophobization treatment is performed in the supercritical carbon dioxide, it is thought that it is possible to obtain hydrophobic silica particles with less remaining of, for example, decomposition products of the hydrophobizing agent and an alkali catalyst (for example, ammonia or the like) that is used in the sol-gel method are obtained. It is thought that the reason for this is that these residues easily move to the supercritical carbon dioxide.

Particularly, conventionally, the alkali catalyst (for example, ammonia or the like) that is used in the sol-gel method is required to be removed by high-temperature drying. However, when the hydrophobization treatment is performed in the supercritical carbon dioxide, it is possible to remove the alkali catalyst at a relatively low temperature, and thus it is thought that the generation of coarse aggregates of silica particles resulting from the high-temperature drying may be prevented.

As a result, it is also possible to omit the residue removing process.

In addition, it is thought that when the hydrophobization treatment is performed in the supercritical carbon dioxide, the hydrophobization treatment is relatively uniformly performed in a short period of time with a small amount of a hydrophobizing agent. In addition, the generation of coarse aggregates is also suppressed. It is thought that the reason for this is that due to the supercritical carbon dioxide, the hydrophobizing agent dissolved therein easily reaches the surfaces of the hydrophilic silica particles.

In view of this, the method of producing the hydrophobic silica particles according to this exemplary embodiment is more favorable than a dry hydrophobization treatment in which the particle aggregation easily occurs and the conventional uniform treatment is difficult to realize and a conventional wet hydrophobization treatment in which a large amount of a hydrophobizing agent and a long treatment time are required to realize the uniform treatment.

Hereinafter, the method of performing a hydrophobization treatment by a hydrophobizing agent under the supercritical carbon dioxide atmosphere will be described in detail.

Specifically, in this method, for example, hydrophilic silica particles (sol-gel silica in this exemplary embodiment) are charged in a closed reactor, and a hydrophobizing agent is added to the hydrophilic silica particles at a predetermined ratio. Then, liquefied carbon dioxide is added to the closed reactor and heated, and the pressure in the reactor is increased by a high-pressure pump to bring the carbon dioxide into a supercritical state. The supercritical state of the carbon dioxide is maintained for a predetermined time. That is, the hydrophobizing agent is reacted in the supercritical carbon dioxide to perform the hydrophobization treatment for the hydrophilic silica particles. After the reaction, the pressure in the closed reactor is reduced and the reactor is cooled.

Here, the supercritical carbon dioxide is carbon dioxide that is at a temperature and pressure exceeding the critical points, and has both the diffusibility of a gas and the solubility of a liquid.

The amount of the hydrophilic silica particles with respect to the capacity of the reactor (charged amount) is, for example, from 50 g/L to 600 g/L, preferably from 100 g/L to 500 g/L, and more preferably from 150 g/L to 400 g/L.

When the amount is less than the above-described range, the concentration of the hydrophobization treatment in the supercritical carbon dioxide is reduced, and thus the contact probability to the silica surface is reduced and the hydrophobic reaction is difficult to proceed. On the other hand, when the amount is greater than the above-described range, the concentration of the hydrophobizing agent in the supercritical carbon dioxide increases, and thus the hydrophobizing agent is not completely dissolved in the supercritical carbon dioxide and defectively dispersed, and coarse aggregates are easily generated.

The density of the supercritical carbon dioxide in the hydrophobization treatment is, for example, from 0.10 g/ml to 0.60 g/ml (or from about 0.10 g/ml to about 0.60 g/ml), preferably from 0.10 g/ml to 0.50 g/ml, and more preferably from 0.2 g/ml to 0.30 g/ml.

When the density is lower than the above-described range, the solubility of the hydrophobizing agent in the supercritical carbon dioxide is reduced and there is a tendency that aggregates are generated. On the other hand, when the density is higher than the above-described range, the dispersibility to the silica micropores is reduced, and thus the hydrophobization treatment is not sufficiently carried out in some cases. Particularly, for sol-gel silica containing many silanol groups, the hydrophobization treatment is required to be performed with the above-described density range.

The density of the supercritical carbon dioxide is adjusted by the temperature, pressure and the like.

Examples of the hydrophobizing agent include a known organic silicon compound having an alkyl group (for example, methyl group, ethyl group, propyl group, butyl group and the like). Specific examples thereof include a silazane compound (for example, silane compounds such as methyltrimethoxysilane, dimethyldimethoxysilane, trimethylchlorosilane and trimethylmethoxysilane, hexamethyldisilazane, tetramethyldisilazane, and the like). The hydrophobizing agents may be used alone or in combination of plural kinds.

Among these hydrophobizing agents, an organic silicon compound having a trimethyl group such as trimethylmethoxysilane and hexamethyldisilazane is preferable.

The amount of the used hydrophobizing agent is not particularly limited. However, in order to obtain a hydrophobization effect, the amount is, for example, from 1 mass % to 60 mass % (or from about 1 mass % to about 60 mass %) with respect to, for example, hydrophilic silica particles, preferably from 5 mass % to 40 mass %, and more preferably from 10 mass % to 30 mass %.

Here, the temperature condition of the hydrophobization treatment (temperature condition under the reaction), that is, the temperature of the supercritical carbon dioxide is, for example, from 140° C. to 210° C., preferably from 155° C. to 185° C., and more preferably from 165° C. to 175° C.

When the temperature is lower than the above-described range, reactivity between the hydrophobizing agent and the surfaces of the hydrophilic silica particles is significantly reduced, and as a result, a dielectric loss factor in the application to the toner may increase. On the other hand, when the temperature is higher than the above-described range, a condensation reaction proceeds between silanol groups of the hydrophilic silica particles, and as a result, an appropriate amount of moisture may not be held. Accordingly, a dielectric loss factor in the application to the toner may be reduced.

The pressure condition of the hydrophobization treatment (pressure condition under the reaction), that is, the pressure of the supercritical carbon dioxide may satisfy the above-described density, and is, for example, from 8 MPa to 30 MPa, preferably from 10 MPa to 25 MPa, and more preferably from 15 MPa to 20 MPa.

Through the above-described hydrophobization treatment processes, hydrophobic sol-gel silica particles are obtained.

(Other Components)

In the toner according to this exemplary embodiment, external additives other than the above-described sol-gel silica may adhere to the toner particles.

Examples of the external additive other than the above-described sol-gel silica include inorganic particles of alumina, titanium oxide, barium titanate, magnesium titanate, calcium titanate, strontium titanate, zinc oxide, silica sand, clay, mica, wollastonite, diatomite, chromium oxide, cerium oxide, colcothar, antimony trioxide, magnesium oxide, zirconium oxide, barium sulfate, barium carbonate, calcium carbonate, silicon carbide, silicon nitride and the like. In addition, resin particles of a fluorine resin, a silicone resin and the like, and metallic salts of higher fatty acid typified by zinc stearate may be used.

The addition amount of the external additive other than the above-described sol-gel silica may be from 0.3 mass % to 3.0 mass % with respect to the total mass of the toner particles.

In order to secure the fluidity of the toner, and from the point of view of suppressing image concentration unevenness, small-diameter silica particles are preferably used as an external additive together with the above-described sol-gel silica, that is, sol-gel silica having a volume average particle diameter of from 70 nm to 400 nm and an average circularity of from 0.5 to 0.9. By using the small-diameter silica particles together, the suppression of a fluctuation in the electrostatic property due to environmental changes over a long period of time is improved.

The volume average particle diameter of the small-diameter silica particles is preferably from 10 nm to 70 nm, and more preferably from 10 nm to 50 nm.

In addition, the small-diameter silica particles are preferably used in the range of from 0.3 mass % to 3.0 mass % with respect to the total mass of the toner particles, and more preferably from 0.5 mass % to 2.0 mass %.

In addition, the shape of the small-diameter silica particles may be any one of a spherical shape and an irregular shape, and any producing method may be employed if the above-described particle diameter range is satisfied.

(Method of Producing Toner)

Next, the method of producing a toner according to this exemplary embodiment will be described.

The toner according to this exemplary embodiment is obtained by externally adding sol-gel silica having a volume average particle diameter of from 70 nm to 400 nm and an average circularity of from 0.5 to 0.9 to toner particles after production of the toner particles.

Examples of the method of producing toner particles include kneading pulverization methods and wet granulation methods, but wet granulation methods, such as a suspension polymerization method, a dissolution suspension method and an emulsion aggregation and coalescence method, by which the material on the surface becomes more uniform and thus a difference between the toner particles is small with regard to the embedding of the external additive are preferably performed. The emulsion aggregation and coalescence method by which the shape is further controlled and a difference in shape between the toner particles is small is particularly preferably performed as a wet granulation method.

Examples of the method of externally adding sol-gel silica and other external additives to the obtained toner particles include mixing methods by known mixers such as a V-shaped blender, a Henschel mixer and a Loedige mixer.

<Electrostatic Charge Image Developer>

An electrostatic charge image developer according to this exemplary embodiment contains at least a toner according to this exemplary embodiment.

The electrostatic charge image developer according to this exemplary embodiment may be a single-component developer containing only the toner according to this exemplary embodiment, or a two-component developer in which the toner and a carrier are mixed.

The carrier is not particularly limited, and examples thereof include known carriers such as a resin-coated carrier, a magnetism dispersion-type carrier and a resin dispersion-type carrier.

The mixing ratio (mass ratio) between the toner according to this exemplary embodiment and the carrier in the two-component developer is preferably in the range of from about 1:100 to about 30:100 (toner:carrier), and more preferably in the range of from about 3:100 to about 20:100.

<Image Forming Apparatus and Image Forming Method>

Next, an image forming apparatus and an image forming method according to this exemplary embodiment using an electrostatic charge image developing toner (electrostatic change image developer) according to this exemplary embodiment will be described.

The image forming apparatus according to this exemplary embodiment includes: an electrostatic latent image holding member; a charging unit that charges a surface of the electrostatic latent image holding member; an electrostatic latent image forming unit that forms an electrostatic latent image on the surface of the electrostatic latent image holding member; a developing unit that contains a developer for electrostatic charge development according to this exemplary embodiment and develops the electrostatic latent image formed on the surface of the electrostatic latent image holding member by using the developer to form a toner image; and a transfer unit that transfers the developed toner image onto a recording medium (a transfer medium). The image forming apparatus according to this exemplary embodiment may further include a fixing unit that fixes the toner image of the recording medium.

According to the image forming apparatus according to this exemplary embodiment, an image forming method is performed that includes: a charging process of charging a surface of the electrostatic latent image holding member; an electrostatic latent image forming process of forming an electrostatic latent image on the charged surface of the electrostatic latent image holding member; a developing process of developing the electrostatic latent image formed on the surface of the electrostatic latent image holding member by using the developer for electrostatic charge development according to this exemplary embodiment to form a toner image; and a transfer process of transferring the toner image onto a recording medium. The image forming method may further include a fixing process of fixing the toner image of the recording medium.

For example, the image formation by the image forming apparatus according to this exemplary embodiment is performed as follows when an electrophotographic photoreceptor is used as the electrostatic latent image holding member. First, a surface of the electrophotographic photoreceptor is charged by a corotron charging device, a contact charging device or the like, and then exposed to form an electrostatic charge image. Next, the image is brought into contact with or approaches a developing roll that has a developer layer formed on a surface thereof to adhere a toner to the electrostatic latent image, and a toner image is formed on the electrophotographic photoreceptor. The formed toner image is transferred onto a surface of a recording medium such as paper by using the corotron charging device or the like. Furthermore, the toner image transferred onto the surface of the recording medium is fixed by the fixing device, and thus the image is formed on the recording medium.

In the image forming apparatus according to this exemplary embodiment, for example, a portion including the developing unit may have a cartridge structure (toner cartridge, process cartridge or the like) that is detachably mounted on the image forming apparatus.

As the toner cartridge, for example, a toner cartridge that includes a toner container containing the electrostatic charge image developing toner according to this exemplary embodiment and is detachably mounted on the image forming apparatus is preferably used.

As the process cartridge, for example, a process cartridge that includes an image holding member and a developing unit that contains the electrostatic charge developer according to this exemplary embodiment and develops an electrostatic latent image formed on a surface of the image holding member to form a toner image, and is detachable from the image forming apparatus is preferably used.

Hereinafter, an example of the image forming apparatus according to this exemplary embodiment will be shown, but the apparatus is not limited thereto. The main portions shown in the drawing will be described, and descriptions of other portions will be omitted.

FIG. 1 is a diagram schematically showing the configuration of a 4-drum tandem color image forming apparatus. The image forming apparatus shown in FIG. 1 includes first to fourth image forming units 10Y, 10M, 100, and 10K (image forming units) of an electrophotographic type that output color images of yellow (Y), magenta (M), cyan (C), and black (K), respectively, based on color-separated image data. The image forming units (hereinafter, simply referred to as "units" in some cases) 10Y, 10M, 10C, and 10K are arranged with a predetermined distance therebetween. The units 10Y, 10M, 10C, and 10K may be process cartridges that is detachable from the image forming apparatus body.

An intermediate transfer belt 20 as an intermediate transfer member is disposed above the units 10Y, 10M, 10C, and 10K in the drawing to extend via the units. The intermediate transfer belt 20 is wound on a driving roller 22 and a support roller 24 contacting the inner surface of the intermediate transfer belt 20, which are separated from each other on the left and right sides in the drawing, and travels in the direction toward the fourth unit 10K from the first unit 10Y. The support roller 24 is pushed in the direction in which it gets away from the driving roller 22 by a spring or the like (not shown), and thus a tension is given to the intermediate transfer belt 20 wound on both of the rollers. In addition, an intermediate transfer member cleaning device 30 opposed to the driving roller 22 is provided in a surface of the intermediate transfer belt 20 on the image holding member side.

Developing devices (developing units) 4Y, 4M, 4C, and 4K of the units 10Y, 10M, 10C, and 10K may be supplied with toners respectively including four color toners of yellow, magenta, cyan, and black contained in toner cartridges 8Y, 8M, 8C, and BK, respectively.

The above-described first to fourth units 10Y, 10M, 10C, and 10K have the same configuration, and thus only the first unit 10Y that is used for forming a yellow image and is disposed on the upstream side in the traveling direction of the intermediate transfer belt will be representatively described. The same portions as in the first unit 10Y will be denoted by the reference numerals having magenta (M) cyan (C), and black (K) added instead of yellow (Y), and descriptions of the second to fourth units 10M, 10C, and 10K will be omitted.

The first unit 10Y includes a photoreceptor 1Y as an image holding member. Around the photoreceptor 1Y, a charging roller 2Y that charges a surface of the photoreceptor 1Y to a predetermined potential, an exposure device (electrostatic charge image forming unit) 3 that exposes the charged surface with a laser beam 3Y based on a color-separated image signal to form an electrostatic charge image, a developing device (developing unit) 4Y that supplies a charged toner to the electrostatic charge image to develop the electrostatic charge image, a primary transfer roller (primary transfer unit) 5Y that transfers the developed toner image onto the intermediate transfer belt 20, and a photoreceptor cleaning device (cleaning unit) 6Y that removes the toner remaining on the surface of the photoreceptor 1Y after the primary transfer, are arranged in sequence.

The primary transfer roller 5Y is disposed on the inside of the intermediate transfer belt 20 and is provided at a position opposed to the photoreceptor 1Y. Bias supplies (not shown) that apply a primary transfer bias are connected to the primary transfer rollers 5Y, 5M, 5C, and 5K, respectively. The bias supplies change the transfer bias that is applied to the respective primary transfer rollers by the control of a controller (not shown).

Hereinafter, the operation of forming a yellow image in the first unit 10Y will be described. First, before the operation, the surface of the photoreceptor 1Y is charged to a potential of about −600 V to about −800 V by the charging roller 2Y.

The photoreceptor 1Y is formed by stacking a photoconductive layer on a conductive substrate (volume resistivity at 20° C.: $1\times10^{-6}$ Ωcm or less). This photoconductive layer typically has high resistance (resistance corresponding to the resistance of a general resin), but has a property that, when the laser beam 3Y is applied thereto, the specific resistance of a portion irradiated with the laser beam changes. Accordingly, the laser beam 3Y is output to the surface of the charged photoreceptor 1Y via the exposure device 3 in accordance with image data for yellow sent from the controller (not shown). The laser beam 3Y is applied to the photoconductive layer on the surface of the photoreceptor 1Y, whereby an electrostatic charge image of a yellow print pattern is formed on the surface of the photoreceptor 1Y.

The electrostatic charge image is an image formed on the surface of the photoreceptor 1Y by the charging, and is a so-called negative latent image, that is formed by applying the laser beam 3Y to the photoconductive layer so that the specific resistance of the irradiated portion is lowered to cause charges to flow on the surface of the photoreceptor 1Y and cause charges to stay in a portion to which the laser beam 3Y is not applied.

The electrostatic charge image that is formed in this manner on the photoreceptor 1Y is rotated to a predetermined development position with the travelling of the photoreceptor 1Y. The electrostatic charge image on the photoreceptor 1Y is visualized (to form a developed image) at the development position by the developing device 4Y.

The electrostatic charge image developer according to this exemplary embodiment including, for example, at least a yellow toner and a carrier is contained in the developing device 4Y. The yellow toner is frictionally charged by being stirred in the developing device 4Y to have a charge with the same polarity (negative polarity) as the electrified charge on the photoreceptor 1Y, and is thus held on the developer roll (developer holding member). By allowing the surface of the photoreceptor 1Y to pass through the developing device 4Y, the yellow toner is electrostatically adhered to an erased latent image portion on the surface of the photoreceptor 1Y, whereby the latent image is developed with the yellow toner. Next, the photoreceptor 1Y having a yellow toner image formed thereon travels at a predetermined speed, and the developed toner image on the photoreceptor 1Y is transported to a predetermined primary transfer position.

When the yellow toner image on the photoreceptor 1Y is transported to the primary transfer position, a primary transfer bias is applied to the primary transfer roller 5Y and an electrostatic force toward the primary transfer roller 5Y from the photoreceptor 1Y acts on the toner image, whereby the toner image on the photoreceptor 1Y is transferred onto the intermediate transfer belt 20. The transfer bias applied at this time has the opposite polarity (+) of the toner polarity (−) and is controlled to, for example, about +10 μA in the first unit 10Y by the controller (not shown).

On the other hand, the toner remaining on the photoreceptor 1Y is removed and recovered by the cleaning device 6Y.

The primary transfer biases that are applied to the primary transfer rollers 5M, 5C, and 5K of the second unit 10M and the subsequent units are also controlled in the same manner as in the case of the first unit.

In this manner, the intermediate transfer belt 20 onto which the yellow toner image is transferred in the first unit 10Y is sequentially transported through the second to fourth units 10M, 10C, and 10K, and the toner images of respective colors are multiply transferred in a superimposed manner.

The intermediate transfer belt 20 onto which four color toner images have been multiply transferred through the first to fourth units reaches a secondary transfer portion which includes the intermediate transfer belt 20, the support roller 24 contacting the inner surface of the intermediate transfer belt, and a secondary transfer roller (secondary transfer unit) 26 disposed on the image supporting surface side of the intermediate transfer belt 20. On the other hand, a recording sheet (transfer medium) P is supplied to a gap between the secondary transfer roller 26 and the intermediate transfer belt 20, which are pressed against each other, at a predetermined time by a supply mechanism, and a secondary transfer bias is applied to the support roller 24. The transfer bias applied at this time has the same polarity (−) as the toner polarity (−) and an electrostatic force toward the recording sheet P from the intermediate transfer belt 20 acts on the toner image, whereby the toner image on the intermediate transfer belt 20 is transferred onto the recording sheet P. The secondary transfer bias is determined depending on the resistance detected by a resistance detecting unit (not shown) that detects the resistance of the secondary transfer portion, and is voltage-controlled.

Thereafter, the recording sheet P is fed to a pressed portion (nip portion) of a pair of fixing rolls in the fixing device (roll-like fixing unit) 28, the toner image is heated, and the color-superimposed toner image is melted and fixed onto the recording sheet P.

Examples of the transfer medium onto which the toner image is to be transferred include plain paper sheets and OHP sheets that are used in electrophotographic copiers, printers, and the like.

In order to further improve the smoothness of an image surface after the fixing, the surface of the transfer medium is preferably as smooth as possible. For example, a coated sheet obtained by coating the surface of a plain paper sheet with a resin or the like, an art paper sheet for printing or the like may be preferably used.

The recording sheet P on which the fixation of the color image has been completed is transported toward a discharge portion, and a series of color image forming operations end.

The image forming apparatus exemplified as above has a configuration in which the toner image is transferred onto the recording sheet P via the intermediate transfer belt 20. However, the invention is not limited to this configuration, and may have a structure in which the toner image may be transferred directly onto the recording sheet from the photoreceptor.

<Process Cartridge, Toner Cartridge>

Figure 2:
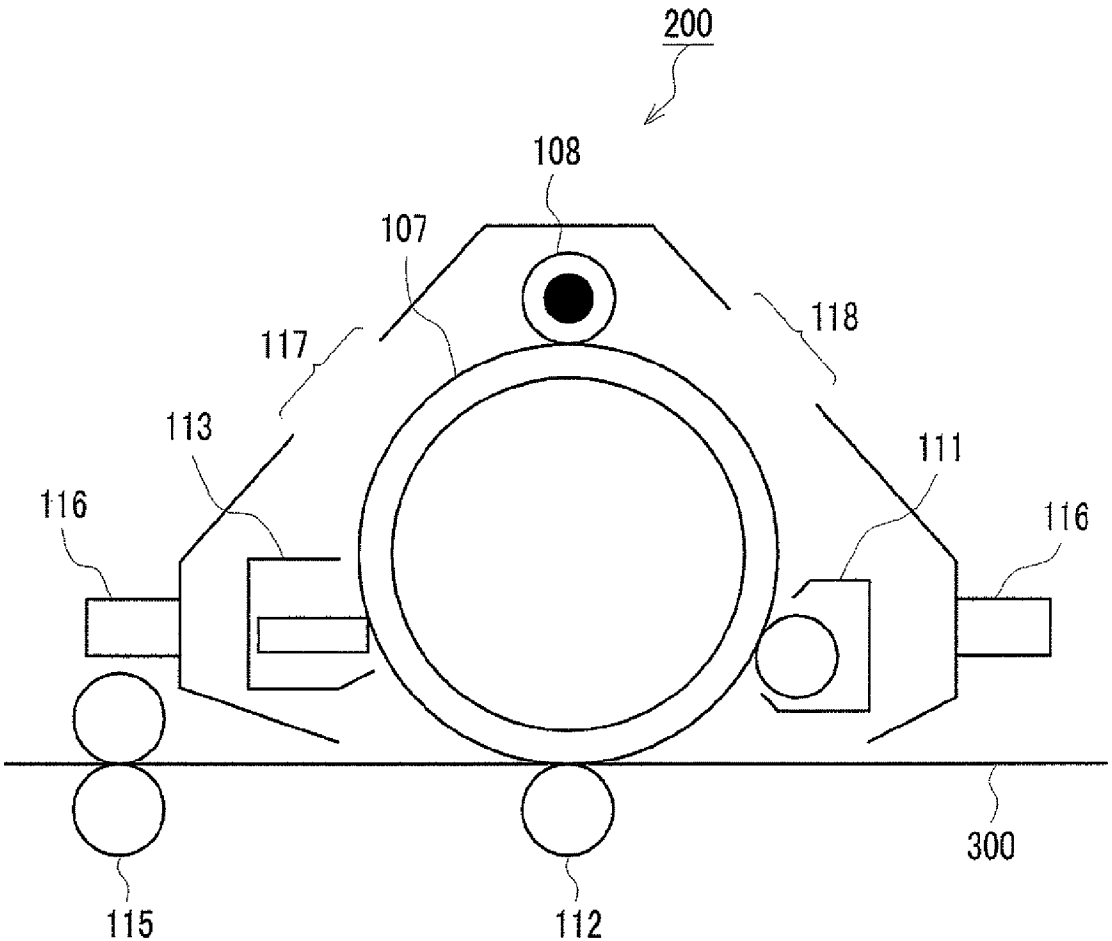
FIG. 2 is a diagram schematically showing the configuration of an example of a process cartridge according to the exemplary embodiment.

FIG. 2 is a diagram schematically showing the configuration of a preferred exemplary embodiment of the process cartridge that contains the electrostatic charge image developer according to this exemplary embodiment. A process cartridge 200 has, in addition to a photoreceptor 107, a charging device 108, a developing device 111, a cleaning device 113, an opening portion 118 for exposure, and an opening portion 117 for erasing exposure that are attached thereto, and combined and integrated using a rail 116. The reference numeral 300 in FIG. 2 represents a transfer medium.

The process cartridge 200 is detachable from an image forming apparatus including a transfer device 112, a fixing device 115 and other constituent portions (not shown).

The process cartridge 200 shown in FIG. 2 includes the charging device 108, the developing device 111, the cleaning device 113, the opening portion 118 for exposure, and the opening portion 117 for erasing exposure, but these devices may be selectively combined in the process cartridge. The process cartridge according to this exemplary embodiment may include, in addition to the photoreceptor 107, at least one selected from the group consisting of the charging device 108, the developing device 111, the cleaning device (cleaning unit) 113, the opening portion 118 for exposure, and the opening portion 117 for erasing exposure.

The toner cartridge according to this exemplary embodiment will be described. The toner cartridge according to this exemplary embodiment is a toner cartridge that includes a toner container containing an electrostatic charge image developing toner and is detachable from the image forming apparatus.

The image forming apparatus shown in FIG. 1 is an image forming apparatus that has a configuration in which the toner cartridges 8Y, 8M, 8C, and 8K are detachably mounted. The developing devices 4Y, 4M, 4C, and 4K are connected to the toner cartridges corresponding to the respective developing devices (colors) via toner supply tubes (not shown). In addition, when the toner contained in a toner cartridge runs low, the toner cartridge is replaced.

EXAMPLES

Hereinafter, this exemplary embodiment will be described in more detail with Examples and Comparative Examples, but is not limited to any of these Examples. In addition, "parts" represents "parts by mass" unless particular notice is given.

[Production of Sol-Gel Silica Particles]

<Sol-Gel Silica (S1)>

(Granulation Process)

—Alkali Catalyst Solution Preparation Process (Preparation of Alkali Catalyst Solution)—

300 parts by mass of methanol and 47.8 parts by mass of 10% ammonia water are put into a 3 L-capacity reaction container made of glass that has a metallic stirring blade, a dropping nozzle (micro-tube pump made of Teflon (trade name)), and a thermometer, and stirred and mixed. Thus, an alkali catalyst solution is obtained.

—Particle Forming Process (Preparation of Sol-Gel Silica Particle Suspension)—

Next, the temperature of the alkali catalyst solution is adjusted to 25° C., and the alkali catalyst solution is put in a nitrogen atmosphere. Thereafter, while stirring the alkali catalyst solution, 450 parts by mass of tetramethoxysilane (TMOS) and 270 parts by mass of ammonia water having a catalyst ($NH_3$) concentration of 4.44 are dropped at the same time with the following supply amounts to obtain a suspension of sol-gel silica particles (sol-gel silica particle suspension).

Here, the supply amount of tetramethoxysilane is adjusted to 7.1 parts by mass/min, and the supply amount of 4.44% ammonia water is adjusted to 4.26 parts by mass/min.

The volume average particle diameter (D50v) of the particles of the obtained sol-gel silica particle suspension, that is measured by the above-described particle size measuring device, is 73 nm.

(Drying Process)

Next, the obtained hydrophilic suspension of sol-gel silica particles (hydrophilic sol-gel silica particle dispersion liquid) is dried by spray drying to remove the solvent to thereby obtain a hydrophilic powder of sol-gel silica particles.

(Hydrophobization Treatment Process)

Next, a hydrophilic silica particle hydrophobization treatment is performed as follows. In the hydrophobization treatment, a device provided with a carbon dioxide cylinder, a carbon dioxide pump, an autoclave with a stirrer, and a back pressure valve is used.

First, 20.0 parts by mass of an obtained powder of hydrophilic silica particles are charged in the autoclave, and then 6 parts by mass of hexamethyldisilazane (produced by Wako Pure Chemical Industries, Ltd.) are charged. Thereafter, the autoclave is filled with liquefied carbon dioxide. The temperature is increased to 170° C. by a heater, and then a pressure is applied to 20 MPa by the carbon dioxide pump. The stirrer is operated at 200 rpm and the materials therein are kept for 30 minutes. After the hydrophobization treatment, the pressure is opened to atmospheric pressure by the back pressure valve and the material is cooled to room temperature. Thereafter, the stirrer is stopped to get a powder of hydrophobic silica particles (S1) treated with the hydrophobizing agent using the autoclave.

The obtained hydrophobic sol-gel silica particles (S1) are added to the toner particles, and a SEM photograph of 100 primary particles of the hydrophobic sol-gel silica particles is taken. Next, the obtained SEM photograph is analyzed, and as a result, the average circularity of the primary particles of the hydrophobic sol-gel silica particles (S1) is 0.743.

[Sol-Gel Silica Particles (S2) to (S19)]

The methanol and 10% ammonia water in the alkali catalyst solution preparation process in the preparation of the sol-gel silica particles (S1) (granulation process), the reaction temperature, the number of parts by mass and the supply amount of tetramethoxysilane (TMOS), and the number of parts by mass, the ammonia concentration and the supply amount of 4.44% ammonia water in the particle forming process, and the treatment temperature in the hydrophobization treatment process are given as in the following Table 1, and thus hydrophobic sol-gel silica particles (S2) to (S19) are obtained.

The particle diameters and the average circularity of the sol-gel silica particles (S2) to (S19) are as in Table 1.

[Production of Toner Particles]

<Preparation of Resin 1 and Resin Particle Dispersion Liquid 1>

35 parts by mol of polyoxyethylene (2,0)-2,2-bis(4-hydroxyphenyl)propane, 65 parts by mol of polyoxypropylene (2,2)-2,2-bis(4-hydroxyphenyl)propane, 80 parts by mol of terephthalic acid, 10 parts by mol of n-dodecenyl succinic acid, 10 parts by mol of isophthalic acid, and 0.05 part by mol with respect to the acid components (total number of moles of the terephthalic acid, n-dodecenyl succinic acid, and isophthalic acid) of dibutyltin oxide are put into a heat-dried flask, the temperature is increased while maintaining an inert atmosphere by introducing a nitrogen gas into the container, and then the materials are subjected to co-condensation polymerization for about 12 hours at a temperature of 150 to 230° C. Then depressurization is gradually carried out at a temperature of 210 to 250° C., and thus an amorphous polyester resin 1 is synthesized.

30 parts by mass of the amorphous polyester resin are dissolved in 100 parts by mass of ethyl acetate, and 1.5 parts by mass of an anionic surfactant (sodium dodecylbenzenesulfonate) are added together with 150 parts of ion exchange water. The materials are heated at 60° C. and stirred at 8000 rpm by using an emulsifier (Ultra Turrax T-50, manufactured by IKA Works Gmbh & Co. KG), and then the ethyl acetate is evaporated. Thus, a resin particle dispersion liquid 1 having a volume average particle diameter of 180 nm is produced.

<Preparation of Resin Particle Dispersion Liquid 2>

296 parts by mass of styrene, 104 parts by mass of n-butyl acrylate, 6 parts by mass of acrylic acid, 10 parts by mass of n-dodecylmercaptan, and 1.6 parts by mass of divinyl adipate are mixed, and while the resultant mixture is added to a solution obtained by dissolving 8 parts by mass of an anionic surfactant (produced by Dai-Ichi Kogyo Seiyaku Co., Ltd.: NEOGEN SC) in 550 parts by mass of ion exchange water, and is dispersed and emulsified. While the resultant material is mixed at a slow speed for 10 minutes, 61 parts by mass of

TABLE 1

Preparation Condition of Sol-gel silica particles

| | Granulation Process | | | | | | | | |
|---|---|---|---|---|---|---|---|---|---|
| | Alkali Catalyst | | Particle Forming Process | | | | | | Hydrophobization |
| | Solution Preparation Process | | Reaction | | | $NH_4OH$ | TMOS Flow Rate | $NH_4OH$ Flow Rate | Treatment Process Treatment |
| No. | Methanol Parts by Mass | 10% $NH_4OH$ Parts by Mass | Temperature (° C.) | TMOS Parts by Mass | $NH_4OH$ Parts by Mass | Concentration (wt %) | Parts by Mass/min | Parts by Mass/min | Temperature (° C.) |
| S1 | 300 | 47.8 | 25 | 450 | 270 | 4.44 | 7.1 | 4.26 | 170 |
| S2 | 300 | 48.5 | 25 | 450 | 270 | 4.44 | 7. | 4.20 | 170 |
| S3 | 300 | 49.5 | 25 | 450 | 270 | 4.44 | 7.2 | 4.32 | 170 |
| S4 | 300 | 50.8 | 25 | 450 | 270 | 4.44 | 6.9 | 4.14 | 170 |
| S5 | 300 | 55 | 25 | 450 | 270 | 4.44 | 6.8 | 4.08 | 170 |
| S6 | 300 | 49.5 | 25 | 450 | 270 | 4.44 | 12.5 | 7.50 | 170 |
| S7 | 300 | 49.5 | 25 | 450 | 270 | 4.44 | 8.3 | 4.98 | 170 |
| S8 | 300 | 49.5 | 25 | 450 | 270 | 4.44 | 5.4 | 3.24 | 170 |
| S9 | 300 | 49.5 | 25 | 450 | 270 | 4.44 | 4.2 | 2.52 | 170 |
| S10 | 300 | 49.5 | 25 | 450 | 270 | 4.44 | 7.2 | 4.32 | 200 |
| S11 | 300 | 49.5 | 25 | 450 | 270 | 4.44 | 7.2 | 4.32 | 185 |
| S12 | 300 | 49.5 | 25 | 450 | 270 | 4.44 | 7.2 | 4.32 | 155 |
| S13 | 300 | 49.5 | 25 | 450 | 270 | 4.44 | 7.2 | 4.32 | 140 |
| S14 | 300 | 47.5 | 25 | 450 | 270 | 4.44 | 7.3 | 4.38 | 170 |
| S15 | 300 | 55.7 | 25 | 450 | 270 | 4.44 | 6.9 | 4.14 | 170 |
| S16 | 300 | 49.5 | 25 | 450 | 270 | 4.44 | 13.7 | 8.22 | 170 |
| S17 | 300 | 49.5 | 25 | 450 | 270 | 4.44 | 3.1 | 1.86 | 170 |
| S18 | 300 | 49.5 | 25 | 450 | 270 | 4.44 | 7.2 | 4.32 | 220 |
| S19 | 300 | 49.5 | 25 | 450 | 270 | 4.44 | 7.2 | 4.32 | 110 |

ion exchange water in which 8 parts by mass of ammonium persulfate (produced by Wake Pure Chemical Industries, Ltd.) is dissolved is charged and flowed the nitrogen gas at 0.1 l/min for 20 minutes. Thereafter, while stirring is performed in the flask, the contents are heated to 70° C. by an oil bath and emulsion-polymerized for 5 hours continuously. Thus, a resin particle dispersion liquid 2 is prepared.

<Preparation of Pigment Dispersion Liquid>

C.I. Pigment Blue 15:3 50 parts by mass (copper phthalocyanine, produced by Dainippon Ink & Chemicals, Inc.)

Anionic Surfactant NEOGEN SC (produced by Dai-Ichi Kogyo Seiyaku Co., Ltd.) 5 parts by mass Ion Exchange Water 200 parts by mass The above materials are mixed and dissolved. The mixture is dispersed for 10 minutes by a homogenizer (manufactured by IKA Works Gmbh & Co. KG, Ultra Turrax) and a cyan colorant dispersion liquid having a central particle diameter of 175 nm is thus obtained.

<Preparation of Release Agent Dispersion Liquid>

Wax (WEP-2, produced by NOF corporation) 25 parts by mass

Anionic Surfactant NEOGEN SC (produced by Dai-Ichi Kogyo Seiyaku Co., Ltd.) 5 parts by mass Ion Exchange Water 200 parts by mass The above materials are mixed at 95° C. and sufficiently dispersed by Ultra Turrax T50 (manufactured by IKA Works Gmbh & Co. KG), and then dispersed by a pressure-discharge Gaulin homogenizer. Thus, a wax dispersion liquid having a central diameter of 215 nm is obtained.

<Preparation of Toner Particles (T1)>

The following compositions are mixed and dispersed by a homogenizer (manufactured by IKA Works Gmbh & Co. KG, Ultra Turrax T50) in a round stainless steel flask. Then, the contents in the flask are heated up to 45° C. while being stirred, and are held for 30 minutes at 45° C.

Resin Particle Dispersion Liquid 1: 500 parts by mass

Pigment Dispersion Liquid: 20 parts by mass

Release Agent Dispersion Liquid: 70 parts by mass

Aqueous 10 weight % Polyaluminum Chloride Solution (produced by Asada Chemical INDUSTRY Co., Ltd.): 0.8 part by mass Aqueous 10 mass % Ammonium Sulfate Solution (produced by Asada Chemical INDUSTRY Co., Ltd.): 1.0 part by mass Aqueous 10 mass % Aluminum Sulfate Solution (produced by Asada Chemical INDUSTRY Co., Ltd.): 1.2 parts by mass 20 parts by mass of a resin particle dispersion liquid 1 is added to the contents and held for 30 minutes at a temperature of 48° C. Furthermore, 20 parts by mass of a resin particle dispersion liquid 1 is added and held for 30 minutes at a temperature of 49° C.

When the obtained contents are observed by an optical microscope, the formation of aggregated particles having a particle diameter of about 6.0 μm is confirmed. In an aqueous sodium hydroxide solution, pH is adjusted to 8 and then the temperature is increased to 90° C. Then, the aggregates are coalesced over about 1 hour and cooled. The resultant material is filtrated, sufficiently washed by ion exchange water, and dried, and thus toner particles (T1) are obtained.

When the particle diameters of the toner particles (T1) are measured by a Coulter counter, the volume average particle diameter is 6.0 μm. In addition, the volume GSD, that is an index of the volume particle size distribution, is 1.16.

Here, the volume GSD can be obtained by obtaining the volume average particle diameter D84 at 84% and the volume average particle diameter D16 at 16% in a volume average particle size distribution curve measured using a Coulter counter and by substituting these values into the expression $(D84/D16)^{1/2}$. Furthermore, the above volume average particle diameters represent 50% volume average particle diameters D50.

<Preparation of Toner Particles (T2)>

The following components are mixed and dispersed by a homogenizer (manufactured by IKA Works Gmbh & Co. KG, Ultra Turrax T50) in a round stainless steel flask. Then, the contents in the flask are held at 48° C. for 30 minutes while being stirred.

Resin Particle Dispersion Liquid 1: 500 parts by mass

Pigment Dispersion Liquid: 20 parts by mass

Release Agent Dispersion Liquid: 70 parts by mass

Aqueous 10 mass % Ammonium Sulfate Solution (produced by Asada Chemical INDUSTRY Co., Ltd.): 1.5 parts by mass When the obtained contents are observed by an optical microscope, the formation of aggregated particles having a particle diameter of about 5.8 μm is confirmed. In an aqueous sodium hydroxide solution, pH is adjusted to 8 and then the temperature is increased to 90° C. Then, the aggregates are unified for coalescence over about 1 hour and cooled. The resultant material is then filtrated, sufficiently washed by ion exchange water, and dried, and thus toner particles (T2) are obtained.

When the particle diameters of the toner particles (T2) are measured by a Coulter counter, the volume average particle diameter is 5.8 μm. In addition, the volume GSD, that is an index of the volume particle size distribution, is 1.21.

<Preparation of Toner Particles (T3)>

The following components are mixed and dispersed by a homogenizer (manufactured by IKA Works Gmbh & Co. KG, Ultra Turrax T50) in a round stainless steel flask. Then, the contents in the flask are held at 48° C. for 20 minutes while being stirred.

Resin Particle Dispersion Liquid 2: 320 parts by mass

Pigment Dispersion Liquid: 80 parts by mass

Release Agent Dispersion Liquid: 96 parts by mass

Aqueous 10 mass % Aluminum Sulfate Solution (produced by Asada Chemical INDUSTRY Co., Ltd.): 12 parts by mass Ion Exchange Water: 1270 parts by mass Next, additionally, 80 parts by mass of a resin particle dispersion liquid 2 are slowly charged and held for 30 minutes at 48° C., and then a 1 N aqueous sodium hydroxide solution is added and pH is adjusted to 6.5.

Thereafter, the temperature is increased to 95° C. at a temperature-increase speed of 1° C./min and holding is carried out for 30 minutes. A 0.1 N nitric acid aqueous solution is added, pH is adjusted to 4.8, and the contents are left for 2 hours at 95° C. Thereafter, the 1 N aqueous sodium hydroxide solution is further added, pH is adjusted to 6.5, and the contents are left for 5 hours at 95° C.

After cooling, the resultant material is filtrated, sufficiently washed by ion exchange water, and then dried, and thus toner particles (T3) are obtained.

When the particle diameters of the toner particles (T3) are measured by a Coulter counter, the volume average particle diameter is 5.7 μm. In addition, the volume GSD, that is an index of the volume particle size distribution, is 1.22.

<Preparation of Toner Particles (T4)>

174 parts by mass of an amorphous polyester resin 1 before dispersion, that is used for the toner particles (T1), 16 parts by mass of C.I. Pigment Blue 15:3, and 10 parts by mass of wax (WEP-2, produced by NOF corporation) are put into a Banbury mixer (manufactured by KOBE steel., Ltd), a pressure is applied so that the temperature of the inside is 110±5° C., and kneading is carried out at 80 rpm for 10 minutes. The obtained, kneaded material is cooled and pulverized into coarse particles by a hammer mill. The material is pulverized into fine particles of about 6.8 μm by a jet mill, and then classified by an elbow-jet classifier (manufactured by MATSUBO Corporation), and thus toner particles (T4) are obtained.

The volume average particle diameter of the obtained toner particles (T4) is 5.8 μm. In addition, the volume GSD, that is an index of the volume particle size distribution, is 1.36.

Examples 1 to 16 and Comparative Examples 1 to 6

<Preparation of Toner>

In accordance with the combinations of toner particles with hydrophobic sol-gel silica particles shown in Table 2, 1.5 parts by mass of hydrophobic sol-gel silica particles and 1.0 part by mass of RX50 (produced by Nippon. Aerosil Co., Ltd., average particle diameter: 40 nm) with respect to 100 parts by mass of toner particles are mixed and blended for 3 minutes at 1300 rpm by using a Henschel mixer. Then, the resultant material is sieved with a 45 μm-opening vibration sieve to prepare respective toners.

<Preparation of Carrier>

Ferrite Particles (volume average particle diameter: 35 μm): 100 parts by mass

Toluene: 14 parts by mass

Perfluoroacrylate Copolymer (Critical Surface Tension: 24 dyn/cm): 1.6 parts by mass Carbon Black (trade name: VXC-72, produced by Cabot Corporation, volume resistivity: 100 Ωcm or less): 0.12 part by mass Cross-Linked Melamine Resin Particles (average particle diameter: 0.3 μm, toluene-insoluble): 0.3 part by mass First, carbon black dispersed in toluene is added to a perfluoroacrylate copolymer and dispersed by a sand mill. Next, in the resultant material, the above components other than the ferrite particles are dispersed by a stirrer for 10 minutes to prepare a covering layer-forming liquid. Next, the covering layer-forming liquid and the ferrite particles are put into a vacuum deaeration-type kneader and stirred for 30 minutes at a temperature of 60° C. Then, depressurization is carried out and the toluene is distillated away to form a resin covering layer, whereby a carrier is obtained.

<Preparation of Developer>

36 parts by mass of the obtained respective toners and 414 parts by mass of a carrier are put into a V blender of 2 L and stirred for 20 minutes, and then sieved with a sieve of 212 μm to prepare respective developers. These are set as Examples 1 to 16 and Comparative Examples 1 to 6.

Example 17

A toner is prepared by mixing and blending materials under the same conditions as in Example 1, except that RX50 is not added.

In addition, 36 parts by mass of the obtained toner and 414 parts by mass of a carrier are put into a V blender of 2 L and stirred for 20 minutes, and then sieved with a sieve of 212 μm to prepare a developer. The resultant material is set as Example 17.

<Measurement of Dielectric Loss Factor>

The dielectric loss factors of the toners obtained in the respective examples are measured in the same manner as above.

The results thereof are shown in Table 1.

(Evaluation)

The developers obtained in the respective examples are filled in a developing unit in Docu Centre-III C7600 (modified apparatus) (manufactured by Fuji Xerox Co., Ltd.) and set at a cyan developing machine position. 10000 images are continuously output under the low humidity environment (temperature 28° C., humidity 15%) so that the toner consumption per sheet is 10 mg, and then 10000 images are continuously output under the high humidity environment (temperature 28° C., humidity 85%). Total 20000 images are output to evaluate the electrostatic property and image quality.

—Fluctuation in Electrostatic Property—

The fluctuation in the electrostatic property is expressed as a ratio (A/B) of a charging amount (A) under the high humidity environment after output of 10000 sheets to a charging amount (B) under the low humidity environment after output of 10000 sheets. The charging amount is measured using a blow-off charging amount measuring machine (manufactured by Toshiba Corporation, TB200). The evaluation index is as follows.

A: The fluctuation in the electrostatic property is in the range of from 0.9 to 1.0. Excellent level with no problems.

B: The fluctuation in the electrostatic property is in the range of from 0.8 to less than 0.9. Level with no problems.

C: The fluctuation in the electrostatic property is in the range of from 0.7 to less than 0.8. Practically usable level.

D: The fluctuation in the electrostatic property is less than 0.7. Practically unusable level.

The results are shown in Table 2. In Table 2, the fluctuation in the electrostatic property is expressed as "charge maintainability".

—Image Quality Evaluation—

Regarding the image quality, the image concentration of a first output image and the image concentration of a 20000-th output image, that are output under the low humidity environment are compared with each other. The image concentration is measured using X-Rite 968 (manufactured by X-rite K.K.) (n=5), and the average value is set as the image concentration. The evaluation index is as follows.

A: The fluctuation in the concentration is in the range of from 0.9 to 1.0. Excellent level with no problems.

B: The fluctuation in the concentration is in the range of from 0.8 to less than 0.9. Level with no problems.

C: The fluctuation in the concentration is in the range of from 0.7 to less than 0.8. Practically usable level.

D: The fluctuation in the concentration is less than 0.7. Practically unusable level.

TABLE 2

| | | Sol-Gel Silica | | | Second Silica Particles | Toner Dielectric | Evaluation | |
|---|---|---|---|---|---|---|---|---|
| | Toner Particles | Kind | Average Circularity | Volume Average Particle Diameter (nm) | Volume Average Particle Diameter (nm) | Loss Factor ($\times 10^{-3}$) | Charge Maintainability | Image Quality |
| Example 1 | T1 | S1 | 0.743 | 73 | 40 | 15 | C | C |
| Example 2 | T1 | S2 | 0.746 | 107 | 40 | 15 | B | B |

TABLE 2-continued

| | | Sol-Gel Silica | | | Second Silica Particles | Toner Dielectric | Evaluation | |
|---|---|---|---|---|---|---|---|---|
| | Toner Particles | Kind | Average Circularity | Volume Average Particle Diameter (nm) | Volume Average Particle Diameter (nm) | Loss Factor ($\times 10^{-3}$) | Charge Maintainability | Image Quality |
| Example 3 | T1 | S3 | 0.753 | 149 | 40 | 15 | A | A |
| Example 4 | T1 | S4 | 0.757 | 204 | 40 | 15 | B | B |
| Example 5 | T1 | S5 | 0.753 | 386 | 40 | 15 | C | C |
| Example 6 | T1 | S6 | 0.524 | 149 | 40 | 15 | C | C |
| Example 7 | T1 | S7 | 0.695 | 149 | 40 | 15 | B | B |
| Example 8 | T1 | S8 | 0.816 | 149 | 40 | 15 | B | B |
| Example 9 | T1 | S9 | 0.867 | 149 | 40 | 15 | C | C |
| Example 10 | T1 | S10 | 0.751 | 149 | 40 | 6 | C | C |
| Example 11 | T1 | S11 | 0.751 | 149 | 40 | 9 | B | B |
| Example 12 | T1 | S12 | 0.751 | 149 | 40 | 21 | B | B |
| Example 13 | T1 | S13 | 0.751 | 149 | 40 | 28 | C | C |
| Example 14 | T2 | S3 | 0.753 | 149 | 40 | 15 | B | B |
| Example 15 | T3 | S3 | 0.753 | 149 | 40 | 15 | A | A |
| Example 16 | T4 | S3 | 0.753 | 149 | 40 | 15 | B | C |
| Example 17 | T1 | S3 | 0.753 | 149 | None | 15 | A | B |
| Comparative Example 1 | T1 | S14 | 0.744 | 61 | 40 | 15 | D | D |
| Comparative Example 2 | T1 | S15 | 0.750 | 415 | 40 | 15 | D | D |
| Comparative Example 3 | T1 | S16 | 0.478 | 149 | 40 | 15 | D | D |
| Comparative Example 4 | T1 | S17 | 0.915 | 150 | 40 | 15 | D | D |
| Comparative Example 5 | T1 | S18 | 0.753 | 149 | 40 | 3 | D | D |
| Comparative Example 6 | T1 | S19 | 0.753 | 149 | 40 | 33 | D | D |

From the above results, it is found that in the examples, the fluctuation in the electrostatic property due to environmental changes is small and it is possible to obtain an image with an excellent image quality in comparison to the cases of the comparative examples.

Particularly, it is found that when the particle size distribution of the toner particles is in the range of from 1.19 to 1.15, the result is excellent in comparison to other examples.

In addition, in Example 15, there are no problems in the image concentration as an image quality, but in a 20000-th image, slight gloss unevenness is caused.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

toner particles; and an external additive, wherein the external additive contains sol-gel silica having a volume average particle diameter of from about 70 nm to about 400 nm and an average circularity of from about 0.5 to about 0.9, a dielectric loss factor of the toner is from about $5\times10^{-3}$ to about $30\times10^{-3}$ when the toner is kept for 24 hours under the environment of a temperature of 28° C. and a humidity of 85%, and the sol-gel silica is treated with hydrophobization treatment in supercritical carbon dioxide having a temperature from 140° C. to 210° C.

2. The electrostatic charge image developing toner according to claim 1, wherein the sol-gel silica has a volume average particle diameter of from about 100 nm to about 200 nm.

3. The electrostatic charge image developing toner according to claim 1, wherein the dielectric loss factor of the toner is from about $10\times10^{-3}$ to about $20\times10^{-3}$ when the toner is kept for 24 hours under the environment of a temperature of 28° C. and a humidity of 85%.

4. The electrostatic charge image developing toner according to claim 1, wherein the average circularity of the sol-gel silica is from about 0.7 to about 0.8.

5. The electrostatic charge image developing toner according to claim 1, wherein the toner particles contain a release agent.

6. The electrostatic charge image developing toner according to claim 1, wherein a volume average particle size distribution index (GSDv) of the toner particles is from 1.13 to 1.25.

7. The electrostatic charge image developing toner according to claim 1, wherein the hydrophobization treatment for the sol-gel silica is performed under the condition that the density of the supercritical carbon dioxide is from about 0.10 g/ml to about 0.60 g/ml.

8. The electrostatic charge image developing toner according to claim 7, wherein in the hydrophobization treatment for the sol-gel silica, a hydrophobizing agent is used in the range of from about 1 mass % to about 60 mass % with respect to the silica particles.

9. An electrostatic charge image developer comprising the electrostatic charge image developing toner according to claim 1.

10. The electrostatic charge image developer according to claim 9, wherein the dielectric loss factor of the electrostatic charge image developing toner is from about $10\times10^{-3}$ to about $20\times10^{-3}$ when the toner is kept for 24 hours under the environment of a temperature of 28° C. and a humidity of 85%.

11. An image forming method comprising:

charging a surface of an image holding member;

forming an electrostatic latent image on the surface of the image holding member;

developing the electrostatic latent image formed on the surface of the image holding member by using a developer to form a toner image; and transferring the developed toner image onto a transfer medium, wherein the developer is the electrostatic charge image developer according to claim 9.

12. The image forming method according to claim 11, wherein the dielectric loss factor of the electrostatic charge image developing toner is from about $10\times10^{-3}$ to $20\times10^{-3}$ when the toner is kept for 24 hours under the environment of a temperature of 28° C. and a humidity of 85%.

* * * * *